US012428807B1

(12) United States Patent
Blahna

(10) Patent No.: US 12,428,807 B1
(45) Date of Patent: Sep. 30, 2025

(54) DITCH DIGGER ATTACHMENT

(71) Applicant: Jeremiah Blahna, Carrington, ND (US)

(72) Inventor: Jeremiah Blahna, Carrington, ND (US)

( * ) Notice: Subject to any disclaimer, the term of this patent is extended or adjusted under 35 U.S.C. 154(b) by 0 days.

(21) Appl. No.: 18/809,035

(22) Filed: Aug. 19, 2024

(51) Int. Cl.
*E02F 5/08* (2006.01)
*E02F 3/96* (2006.01)
*E02F 5/14* (2006.01)

(52) U.S. Cl.
CPC ..... *E02F 5/08* (2013.01); *E02F 3/96* (2013.01); *E02F 5/14* (2013.01); *E02F 5/145* (2013.01)

(58) Field of Classification Search
CPC ..... E02F 5/08; E02F 5/14; E02F 5/145; E02F 3/96; E02F 3/186; E02F 3/20; E02F 7/00
See application file for complete search history.

(56) References Cited

U.S. PATENT DOCUMENTS 2,965,985 A * 12/1960 Nielsen ..... E02F 5/022 172/58
3,132,430 A * 5/1964 Barras ..... E02F 3/20 37/92
3,624,826 A * 11/1971 Rogers ..... E02F 5/282 172/393
4,161,072 A * 7/1979 Pronovost ..... E02F 3/20 37/364
4,612,715 A 9/1986 Cartner
5,113,610 A * 5/1992 Liebrecht, Jr. ..... E02F 3/20 37/189
6,249,993 B1 * 6/2001 Armstrong ..... E02F 9/20 37/361
6,336,280 B1 1/2002 Haigh
7,748,421 B2 * 7/2010 Everett ..... A01G 23/067 144/172
8,881,432 B1 * 11/2014 German ..... E02F 3/964 37/92
9,739,033 B2 * 8/2017 Thompson ..... E02F 5/282
2017/0121934 A1 * 5/2017 Desbiens ..... E02F 3/183

* cited by examiner

*Primary Examiner* — Joseph M Rocca
*Assistant Examiner* — Robert E Pezzuto
(74) *Attorney, Agent, or Firm* — Fargo Patent & Business Law; Thomas Kading; Joshua Krank

(57) ABSTRACT

A ditch digger assembly for a skid steer includes a frame attachable to the skid steer, an overhung load adaptor mounted to the frame along an axis; a rotor rotationally mounted to the overhung load adaptor along the axis; and a bi-directional hydraulic drive motor along the axis to drive the rotor through the overhung load adaptor.

15 Claims, 6 Drawing Sheets

DITCH DIGGER ATTACHMENT

CROSS REFERENCE TO RELATED APPLICATION[S]

None

BACKGROUND

The present disclosure relates to a ditch digger assembly, and more specifically to a ditch digger assembly mountable to compact construction equipment.

The excavation of a drainage ditch may be accomplished with draglines and dozers. The draglines may be of various sizes, depending on the required excavation and the distance necessary to reach the excavation area. In some applications, excavators that use tracks (trackhoes) may be used to excavate drainage ditches. Trackhoes may be more efficient for excavating small ditches than draglines that do not require the use of a large capacity machine. Trackhoes and draglines equipped with wide tracks can operate under wet field conditions, however, leveling wet soil may result in future crop losses in the affected area. Other large capacity machines such as rotary power ditchers mounted to a tractor's 3-point hitch may also be used to excavate drainage ditches.

Although effective, convectional machines for excavation of a drainage ditch are rather large, complex, and may not work well in wet soil conditions.

SUMMARY

A ditch digger assembly for a skid steer according to one disclosed non-limiting embodiment of the present disclosure includes a frame attachable to the skid steer; a rotor rotationally mounted to the frame about an axis; and a bi-directional hydraulic drive motor to drive the rotor.

A further embodiment of any of the foregoing embodiments of the present disclosure includes, wherein, wherein the rotor includes a multiple of blades arranged about the axis.

A further embodiment of any of the foregoing embodiments of the present disclosure includes a guard that extends at an angle with respect to the axis from the frame, the guard extends at least partially forward of the rotor.

A further embodiment of any of the foregoing embodiments of the present disclosure includes that the guard extends above the rotor with respect to the ground.

A further embodiment of any of the foregoing embodiments of the present disclosure includes a cutter that extends from the frame parallel to the axis, the cutter extends at least partially forward of the rotor opposite the guard with respect to the axis.

A further embodiment of any of the foregoing embodiments of the present disclosure includes that the cutter extends below the rotor with respect to the ground.

A further embodiment of any of the foregoing embodiments of the present disclosure includes a guard that extends at an angle with respect to the axis from the frame, the guard extends at least partially forward of the rotor, the guard extends above the rotor with respect to the ground; and a cutter that extends from the frame parallel to the axis, the cutter extends at least partially forward of the rotor opposite the guard with respect to the axis, the cutter extends below the rotor with respect to the ground.

A further embodiment of any of the foregoing embodiments of the present disclosure includes that the axis is within a vertical longitudinal plane along the centerline of the skid steer.

A further embodiment of any of the foregoing embodiments of the present disclosure includes that a first bearing mounted to the frame along the axis; a second bearing mounted to the frame along the axis; and a shaft rotationally mounted within the first bearing and the second bearing along the axis, the rotor mounted to the shaft.

A further embodiment of any of the foregoing embodiments of the present disclosure includes an overhung load adaptor mounted to the frame about the axis, the rotor rotationally mounted to the overhung load adaptor along the axis.

A ditch digger assembly for a skid steer according to one disclosed non-limiting embodiment of the present disclosure includes a frame attachable to the skid steer; a first bearing mounted to the frame along an axis; a second bearing mounted to the frame along the axis; a shaft rotationally mounted within the first bearing and the second bearing along the axis; a rotor mounted to the shaft; and a bi-directional hydraulic drive motor along the axis to drive the shaft.

A further embodiment of any of the foregoing embodiments of the present disclosure includes that the axis is within a vertical longitudinal plane along the centerline of the skid steer.

A further embodiment of any of the foregoing embodiments of the present disclosure includes a controller operable to control the bi-directional hydraulic drive motor to selectively rotate the rotor about the axis in either a clockwise or counterclockwise direction.

A further embodiment of any of the foregoing embodiments of the present disclosure includes a guard that extends at an angle with respect to the axis from the frame, the guard extends at least partially forward of the rotor.

A further embodiment of any of the foregoing embodiments of the present disclosure includes a cutter that extends from the frame parallel to the axis, the cutter extends at least partially forward of the rotor opposite a guard with respect to the axis.

A ditch digger assembly for a skid steer according to one disclosed non-limiting embodiment of the present disclosure includes a frame attachable to the skid steer; an overhung load adaptor mounted to the frame along an axis; a rotor rotationally mounted to the overhung load adaptor along the axis; and a bi-directional hydraulic drive motor along the axis to drive the rotor through the overhung load adaptor.

A further embodiment of any of the foregoing embodiments of the present disclosure includes a controller operable to control the bi-directional hydraulic drive motor to selectively rotate the rotor about the axis in either a clockwise or counterclockwise direction.

A further embodiment of any of the foregoing embodiments of the present disclosure includes a guard that extends at an angle with respect to the axis from the frame, the guard extends at least partially forward of the rotor.

A further embodiment of any of the foregoing embodiments of the present disclosure includes a cutter that extends from the frame parallel to the axis, the cutter extends at least partially forward of the rotor opposite a guard with respect to the axis.

A further embodiment of any of the foregoing embodiments of the present disclosure includes that the axis is within a vertical longitudinal plane along the centerline of the skid steer.

The foregoing features and elements may be combined in various combinations without exclusivity, unless expressly indicated otherwise. These features and elements as well as the operation thereof will become more apparent in light of the following description and the accompanying drawings. It should be appreciated that however the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
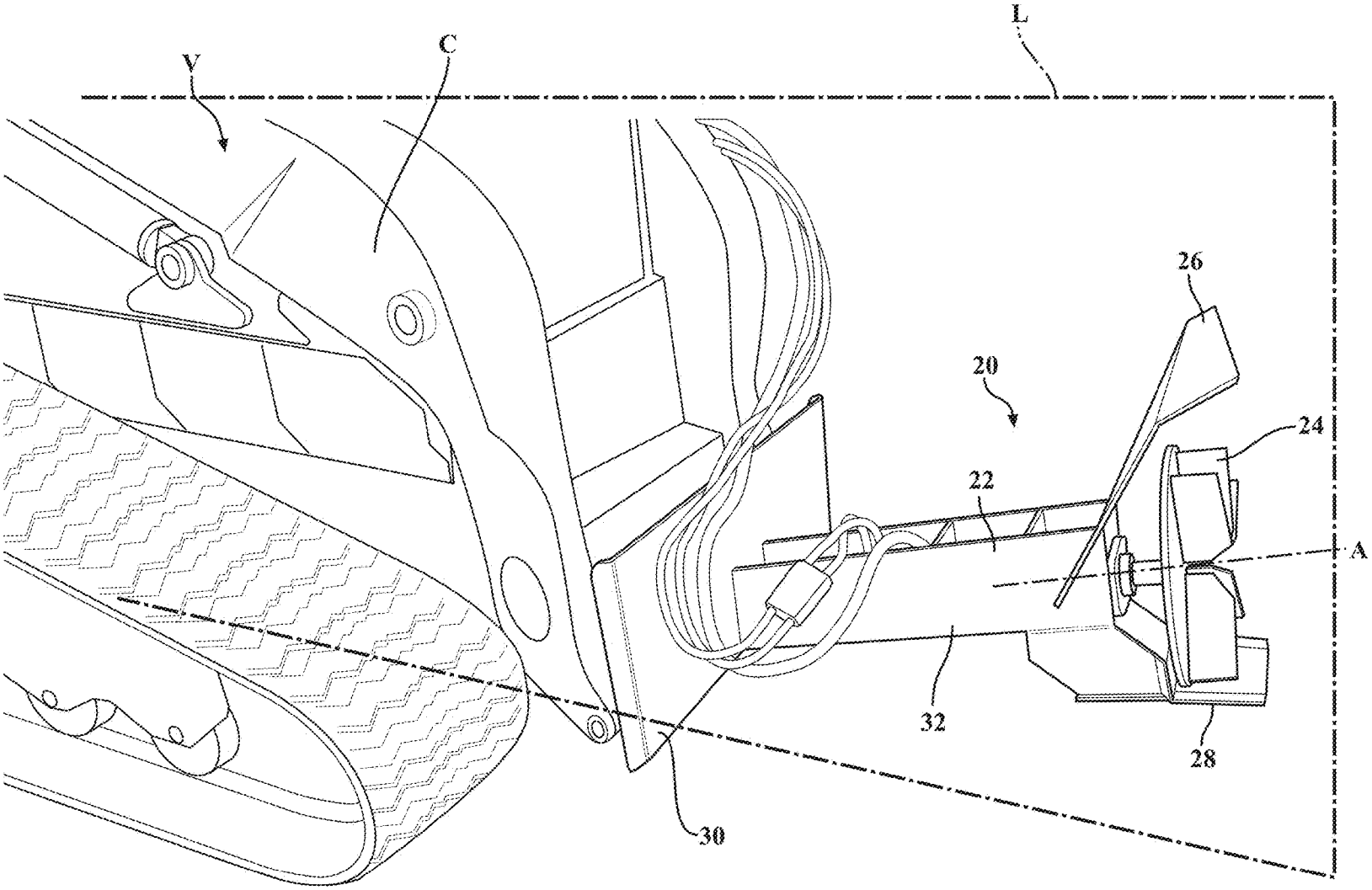
FIG. 1 is a side perspective view of a ditch digger assembly according to one disclosed non-limiting embodiment.

FIG. 1 schematically illustrates a ditch digger assembly 20 that is supported by a plurality of lift arms C which connect the ditch digger assembly 20, via an attachment interface, with a vehicle V such as compact construction equipment to include, but not be limited to, skid steer loaders, compact track loaders, mini track loaders, compact tractors, small articulated loaders, etc. Other vehicles V may also utilize the ditch digger assembly 20 which may be appropriately sized therefor.

The ditch digger assembly 20 may be supported by the lift arms C of the vehicle V which serve to interconnect the ditch digger assembly 20 with the vehicle V. The ditch digger assembly 20 may be interconnected with the vehicle V such that the ditch digger assembly 20 is supported to be lifted, lowered, or otherwise manipulated in a conventional manner. For example, the lift arms C may include parallel linkage and may be manipulated by hydraulic cylinders powered by the vehicle hydraulic system.

Figure 2:
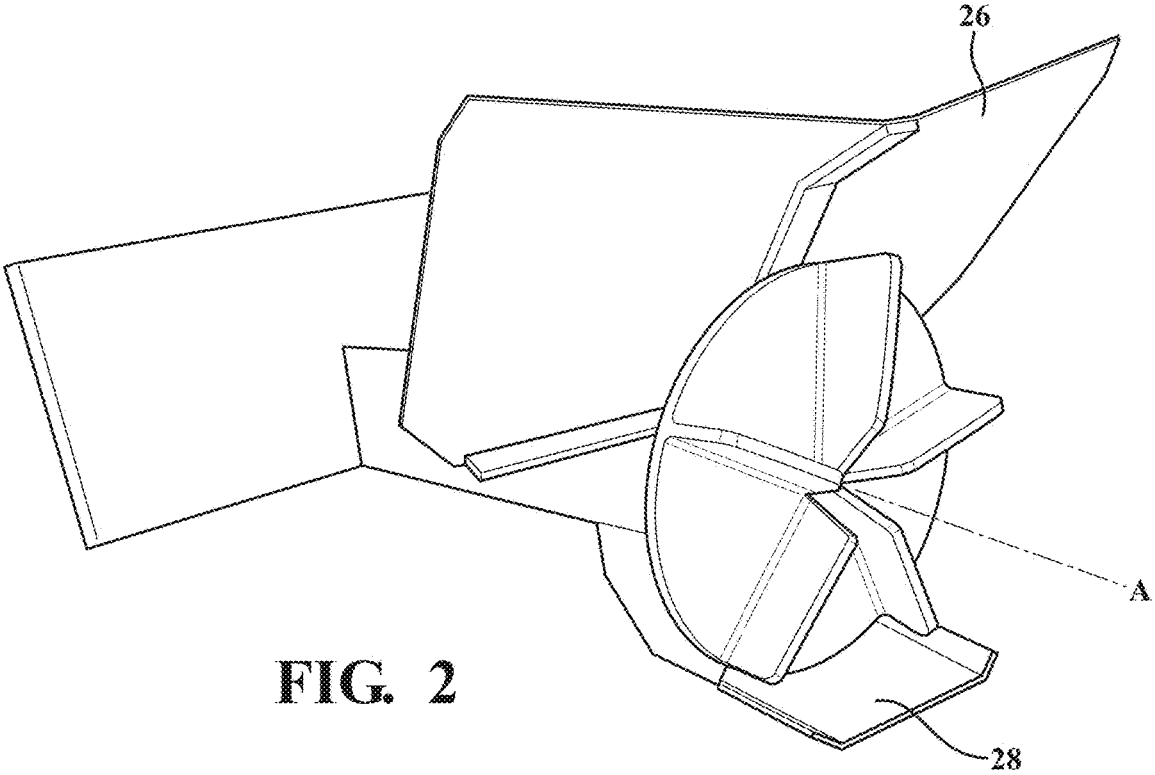
FIG. 2 is an expanded front quarter perspective view of the ditch digger assembly.
Figure 3:
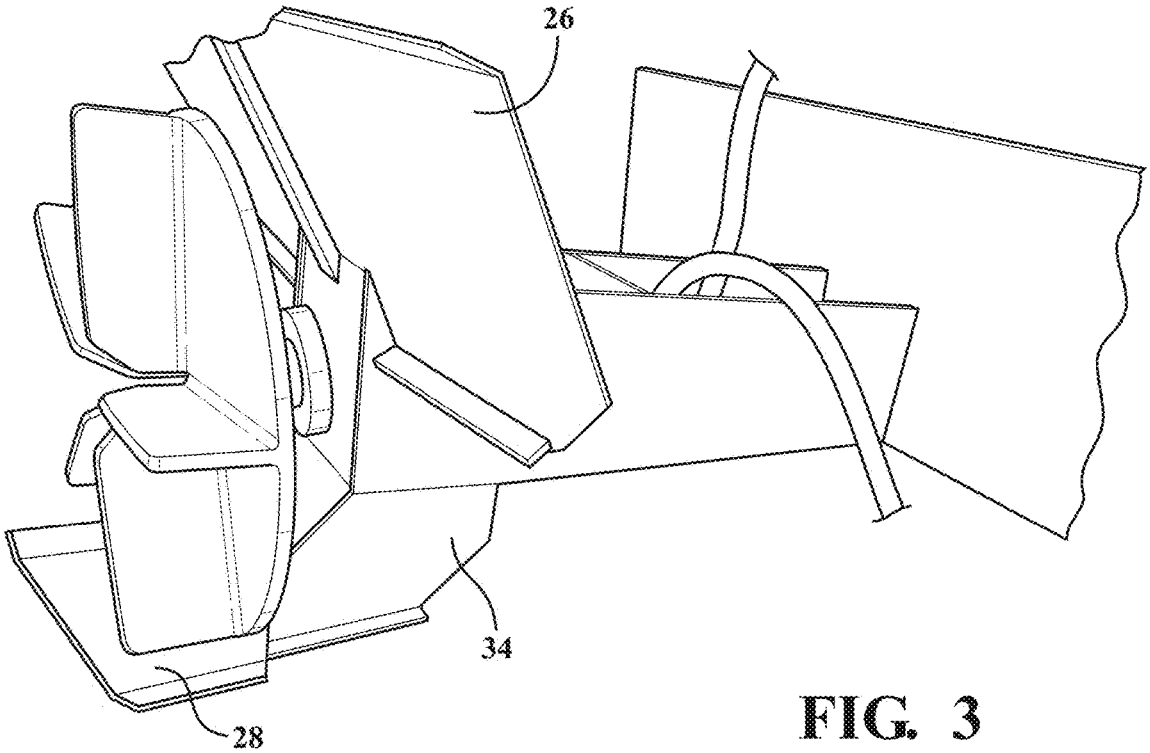
FIG. 3 is an expanded partial front quarter perspective view of the ditch digger assembly.

The ditch digger assembly 20 generally includes a frame 22, a rotor 24 rotationally mounted to the frame about an axis A, a guard 26 (also shown in FIGS. 2-4) that extends at an angle with respect to the axis A from the frame 22, and a cutter 28 that extends from the frame parallel to the axis A.

The frame 22 may utilize a universal adapter 30 that is engageable with the lift arms C of the vehicle V. Various universal adapters may be provided to facilitate mounting of the ditch digger assembly 20 to a particular vehicle. The universal adapter 30 may include a quick attach or other arrangement.

An arm 32 of the frame 22 extends from the universal adapter 30 to support the rotor 24 for rotation about axis A. The axis A is within a vertical longitudinal plane L along the centerline of the vehicle V. That is, the vertical longitudinal plane L bisects the vehicle and axis A remains within the vertical longitudinal plane L when the ditch digger assembly 20 is lifted, lowered, or otherwise manipulated in a conventional manner by the vehicle V.

The guard 26 (also shown in FIGS. 2-4) extends from the arm 32 at an angle with respect to the axis A. The guard 26 extends at least partially forward and above the rotor 24 with respect to the ground. The guard 26 operates as a dirt deflector and shield during operation for the rotor 24 (FIG. 5).

The cutter 28 extends from the arm 32 generally parallel to the axis A. The cutter 28 extends at least partially forward and below the rotor 24 with respect to the ground. The cutter 28 is positioned generally opposite the guard 26 with respect to the axis A to facilitate lifting of soil upward toward the rotor 24. The cutter 28 may include an angled portion on both sides to further facilitate the lifting of soil (FIGS. 1-4 & 6-7). The cutter 28, by extending forward of and below the rotor 24, also protects the rotor 24 from large rocks etc. The cutter 28 may extend from a skid portion 34 (FIG. 3) of the arm 32 which facilitates depth control of the cutter 28.

Figure 4:
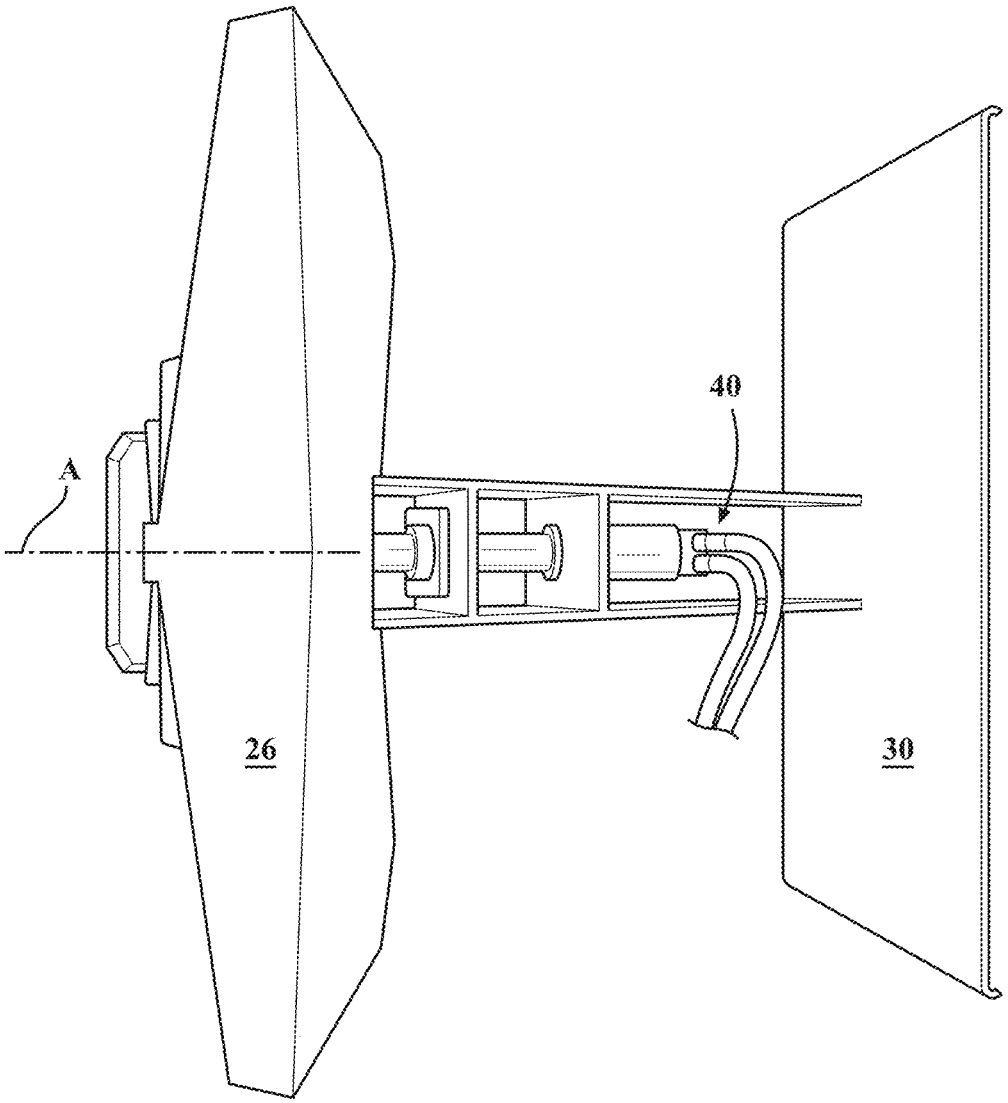
FIG. 4 is a partial top perspective view of the ditch digger assembly.
Figure 5:
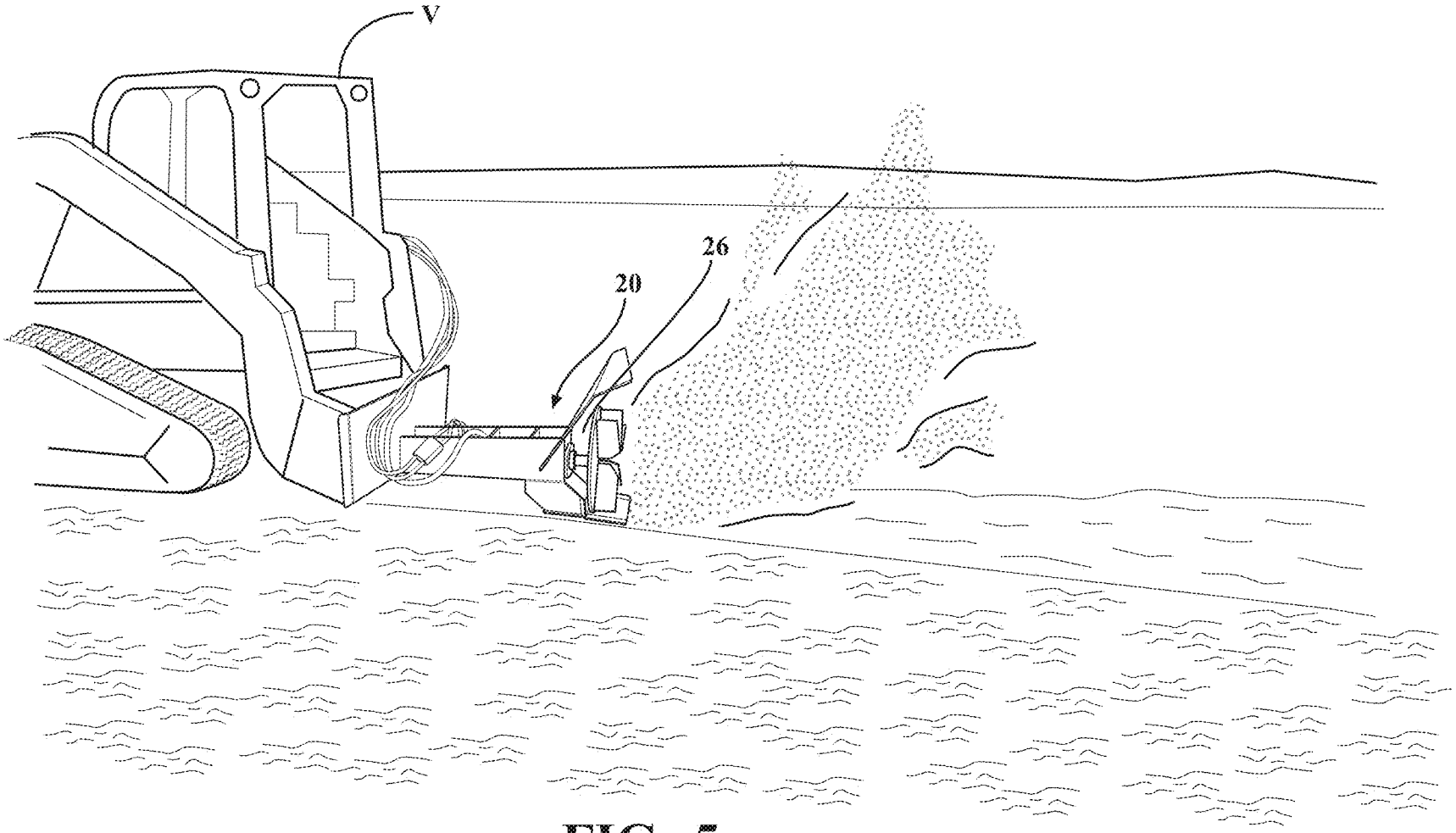
FIG. 5 is a perspective view of a ditch digger assembly in use.

With reference to FIG. 4, the rotor 24 is rotationally mounted to the arm 32 of the frame 22 about the axis A by a drive system 40. The rotor 24 may include a disk with a multiple of blades arranged about the axis A. The drive system 40 may be a hydraulic system, electrical system, and/or mechanical system that is either independent of, or in communication with, a system of the vehicle V. For example, the drive system 40 may include an electric motor, a hydraulic motor, a gear system, and/or combinations thereof.

Figure 6:
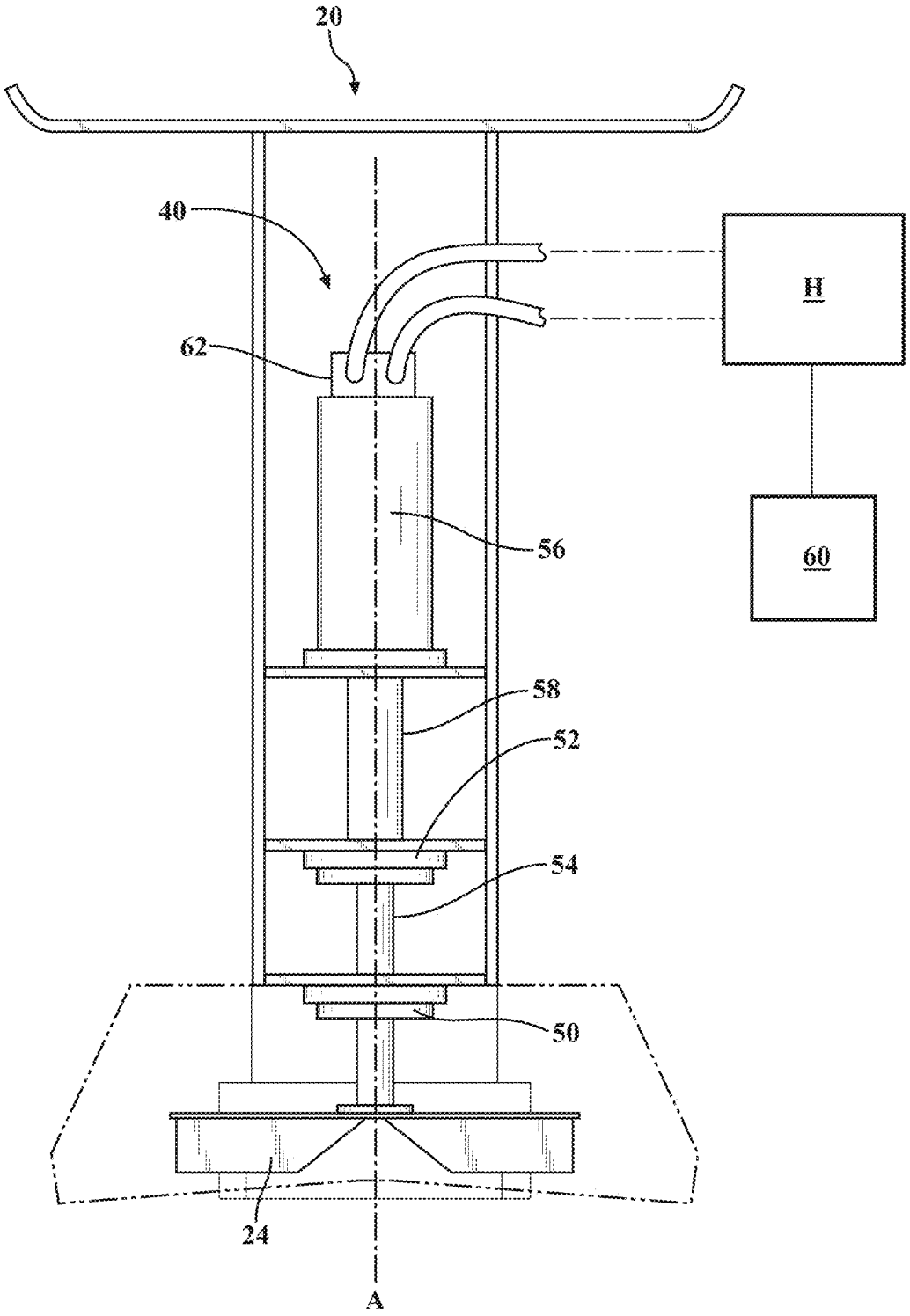
FIG. 6 is a schematic view of a drive system for the ditch digger assembly according to one disclosed non-limiting embodiment.

With reference to FIG. 6, in one embodiment, the drive system 40 may include a first bearing 50 and a second bearing 52 mounted to the arm 32 of the frame 22 along the axis A to support a shaft 54 mounted to the rotor 24. The shaft 54 may be rotated by a bi-directional hydraulic drive motor 56 about the axis A. The shaft 54 may be mounted to the bi-directional hydraulic drive motor 56 via a coupling 58. The coupling 58 may be used for attachment and removal of the shaft 54 and rotor 24 as well as to limit potential damage to the bi-directional hydraulic drive motor 56.

A controller 60 is operable to control the bi-directional hydraulic drive motor 56 through a hydraulic relief valve 62 to selectively rotate the rotor 24 about the axis A in either a clockwise or counterclockwise direction. The hydraulic relief valve 62 connects to the vehicle V hydraulic power system H to drive the rotor 24 and as a safety mechanism to diverting oil flow back to the tank to prevent possible pressure-induced damage.

The controller 60 may be an independent controller and/or that which is integrated in the vehicle V to operate the bi-directional hydraulic drive motor 56. That is, the controller 60, may be integrated with, independent of, or in communication with, a system of the vehicle V.

Figure 7:
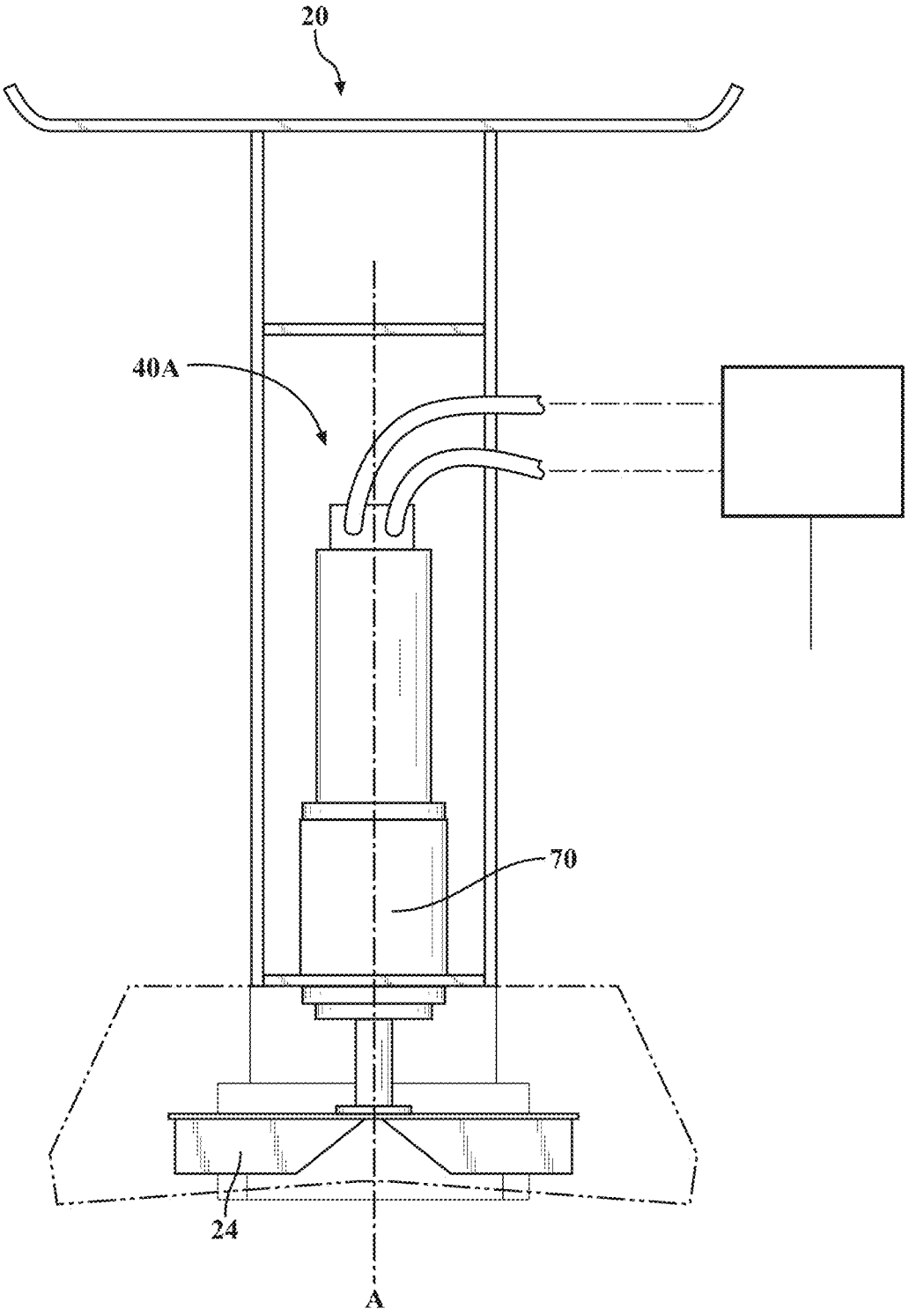
FIG. 7 is a schematic view of a drive system for the ditch digger assembly according to another disclosed non-limiting embodiment

With reference to FIG. 7, in another embodiment, the drive system 40A includes an overhung load adaptor 70 mounted to the frame 22 along the axis A to support the bi-directional hydraulic drive motor 56. The bi-directional hydraulic drive motor 56 is powered through the hydraulic relief valve 62 as described above. The overhung load adaptor 70 provides support for radial and axial loads resulting in extended life of the bi-directional hydraulic drive motor 56, seals out dirt, grime, and other contaminants, prevents contamination of hydraulic fluid in harsh environments, provides solid mounting surface, and permits the removal of hydraulic motors for servicing without disturbing driven gears, pulleys, sprockets, etc.

The ditch digger assembly 20 is located forward of the vehicle V, rotates at a sufficient speed to spread dirt far enough from excavation, pushes rocks aside instead of tossing them, is uncomplicated, and works well in wet soil.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed:

1. A ditch digger assembly for a skid steer, comprising:
- a frame attachable to the skid steer;
- a rotor rotationally mounted to the frame about an axis, the rotor comprises a disk with a multiple of blades arranged about the axis on a face of the disk;
- a bi-directional hydraulic drive motor to drive the rotor;
- a guard that extends at an angle with respect to the axis from the frame, the guard extends at least partially forward and at least partially above the rotor with respect to the ground; and
- a cutter that extends from the frame parallel to the axis, the cutter extends at least partially forward of the rotor opposite the guard with respect to the axis, the cutter extends at least partially below the rotor with respect to the ground.

2. The ditch digger as recited in claim 1, wherein the axis is within a vertical longitudinal plane along the centerline of the skid steer.

3. The ditch digger as recited in claim 1, further comprising:
- a first bearing mounted to the frame along the axis;
- a second bearing mounted to the frame along the axis; and
- a shaft rotationally mounted within the first bearing and the second bearing along the axis, the rotor mounted to the shaft.

4. The ditch digger as recited in claim 1, further comprising an overhung load adaptor mounted to the frame about the axis, the rotor rotationally mounted to the overhung load adaptor along the axis.

5. The ditch digger as recited in claim 1, wherein the frame comprises a universal adapter that is engageable with lift arms of the skid steer.

6. The ditch digger as recited in claim 5, further comprising an arm that extends from the universal adapter, the arm supports the rotor for rotation about axis in a fixed orientation with respect to the universal adapter.

7. The ditch digger as recited in claim 6, wherein the guard extends from the arm at an angle with respect to the axis.

8. The ditch digger as recited in claim 7, further comprising a skid portion that extends from the arm.

9. The ditch digger as recited in claim 8, wherein the cutter extends from the skid portion.

10. A ditch digger assembly for a skid steer, comprising:
- a frame attachable to the skid steer;
- a first bearing mounted to the frame along an axis;
- a second bearing mounted to the frame along the axis;
- a shaft rotationally mounted within the first bearing and the second bearing along the axis;
- a rotor mounted to the shaft for rotation therewith, the rotor comprises a disk with a multiple of blades arranged about the axis on a face of the disk;
- a bi-directional hydraulic drive motor along the axis to drive the shaft;
- a guard that extends at an angle with respect to the axis from the frame, the guard extends at least partially forward and at least partially above the rotor with respect to the ground; and
- a cutter that extends from the frame parallel to the axis, the cutter extends at least partially forward of the rotor opposite the guard with respect to the axis, the cutter extends at least partially below the rotor with respect to the ground.

11. The ditch digger as recited in claim 10, further comprising a controller operable to control the bi-directional hydraulic drive motor to selectively rotate the rotor about the axis in either a clockwise or counterclockwise direction.

12. The ditch digger as recited in claim 10, wherein the axis is within a vertical longitudinal plane along the centerline of the skid steer.

13. A ditch digger assembly for a skid steer, comprising:
- a frame attachable to the skid steer;
- an overhung load adaptor mounted to the frame along an axis;
- a rotor rotationally mounted to the overhung load adaptor along the axis, the rotor comprises a disk with a multiple of blades arranged about the axis on a face of the disk; and
- a bi-directional hydraulic drive motor along the axis to drive the rotor through the overhung load adaptor;
- a guard that extends at an angle with respect to the axis from the frame, the guard extends at least partially forward and at least partially above the rotor with respect to the ground; and
- a cutter that extends from the frame parallel to the axis, the cutter extends at least partially forward of the rotor opposite the guard with respect to the axis, the cutter extends at least partially below the rotor with respect to the ground.

14. The ditch digger as recited in claim 13, further comprising a controller operable to control the bi-directional hydraulic drive motor to selectively rotate the rotor about the axis in either a clockwise or counterclockwise direction.

15. The ditch digger as recited in claim 13, wherein the axis is within a vertical longitudinal plane along the centerline of the skid steer.

* * * * *